United States Patent [19]

de Hedouville

[11] 3,945,226

[45] Mar. 23, 1976

[54] TUB AND DRUM OF A WASHING-MACHINE

[75] Inventor: Philippe de Hedouville, Feuguieres-en-Vimeu, France

[73] Assignee: U.S. Philips Corporation, New York, N.Y.

[22] Filed: Feb. 13, 1974

[21] Appl. No.: 441,970

[30] Foreign Application Priority Data

Feb. 19, 1973 France ..... 73.05799

[52] U.S. Cl. ..... 68/23.1; 68/24; 68/142

[51] Int. Cl.[2]D06F 23/02; D06F 37/04; D06F 37/22

[58] Field of Search ..... 68/139, 140, 142, 23.2, 68/24, 23.1

[56] References Cited

UNITED STATES PATENTS

| | | | |
|---|---|---|---|
| 285,934 | 10/1883 | Smith et al. | 68/142 |
| 2,213,453 | 9/1940 | Schmidt | 68/139 X |
| 2,323,765 | 7/1943 | Haberstump | 68/140 X |
| 2,904,982 | 9/1959 | Bochan | 68/142 UX |
| 3,276,229 | 10/1966 | Deiss | 68/24 X |

FOREIGN PATENTS OR APPLICATIONS

| | | | |
|---|---|---|---|
| 1,213,067 | 10/1959 | France | 68/23.2 |
| 1,407,860 | 6/1965 | France | 68/24 |

*Primary Examiner*—Harvey C. Hornsby
*Assistant Examiner*—Philip R. Coe
*Attorney, Agent, or Firm*—Frank R. Trifari; David R. Treacy

[57] ABSTRACT

A tub for a washing and spin-drying machine having a horizontal spin axis. The flanks of the tub are attached to a cylindrical part by a conical portion; the cross-section of the tub in a plane through the spin axis is rectangular with flattended corners.

4 Claims, 2 Drawing Figures

TUB AND DRUM OF A WASHING-MACHINE

The invention relates to a tub for a washing machine, and more particularly to a washing machine having a drum with a horizontal shaft, a tub resiliently attached to a chassis of the machine and consists of a cylindrical part and two flanks, the edges of said flanks being fixed to the edges of the cylindrical part.

From French Patent Specification 1,212,447 a washing machine is known having a drum with an inclined shaft and an agitator. The tub consists of a cylindrical part which at each side is provided with a frustum of a cone. The frustum of a cone which forms the rear of the tub carries the drive shaft of the basket and the agitator, while that which forms the front part is open towards the inclined front side of the machine, constituting the loading opening. The inclination of the shaft relative to the horizontal axis is of the order of 35°, the dimensions of the bottom which has the shape of a truncated cone are such that the water level can be higher than the agitator, yet remain below the opening which provides access.

The shape of the drum which dictates that of the tub is such, according to the inventor, that it allows an effective and economical washing process owing to the fact that the laundry is moved longitudinally, being moved upwards along the drum, and that it subsequently drops back vertically in a direction which is such that it is taken along towards the agitator. The same movement can be obtained by means of a drum having a horizontal shaft provided with helical blades which are oblique relative to the shaft.

Apparently, the shape of the drum and of the tub are dictated only by technical requirements as a result of the location of the loading door at an oblique panel at the front of the machine and of the use of an agitator in the back of the tub. In order to ensure that the agitator continuously provides an effective action, it is necessary that it be permanently immersed and that it can produce currents in the water.

The first requirement is met by disposing the agitator below the level of the water which reaches almost up to the loading opening, and the second by providing a conical back whose diameter corresponds to that of the agitator. The function and the object of the conicalness of the tub are respectively to produce water currents which move the laundry and to obtain a better washing efficiency.

The tub according to the invention has a shape which resembles that described in the previously cited Specification. For connecting the substantially cylindrical part to the flanks at either side of said part, it is provided with a conical part. The conical shape serves no other purpose than to provide a peripheral zone of small width relative to the dimensions of the flanks. The shape of the tub has a function and a purpose which differ from those aimed at in the prior art, and which will be defined hereinafter.

The tub, in which is mounted a drum movable about a shaft mounted in bearings supported by the tub, is held in position by spring and damping devices. said devices serve to limit the movements and the vibrations of the tub when the drum which contains the load of laundry rotates during washing or spin-drying. The movements of the tub cannot completely be eliminated because the load of the drum presents an unbalance during rotation in the spin-drying mode. A solution might be to substantially increase the mass of the tub by means of additional weights, but this cannot be considered for several reasons. In order to avoid that the tub hits the walls of the machine and causes damage to the housing and to the equipments attached thereto, two steps are generally taken between the wall of the tub and the housing a comparatively wide clearance is left; a contactor device is provided which stops the rotation of the drum at spin-drying speed when the amplitude of the movement of tub reaches a previously determined value, and restarts it at washing speed and with subsequent increase to spin drying speed, or switches the machine back to spin drying speed after a certain time. The movements which are most difficult to damp are those which are produced in vertical planes parallel to the axis of rotation of the drum, that is, due to angular motion of the drum axis in a vertical plane. Said displacements are produced when the mass causing the unbalance collects at an edge of the drum, and in this case the suspension and the shockabsorbers provided for damping movements which are preferably disposed in vertical planes perpendicular to the axis of rotation are relatively ineffective. If the distance between the sides of the tub and the housing is not sufficient, the corners of the tub will hit the walls.

It is an object of the invention to provide a tub which does not have that drawback and which consequently allows a smaller distance between the flanks of the tub and the walls of the housing.

The washing-machine tub, particularly adapted to a washing machine having a drum with a horizontal shaft, the tub being resiliently attached to the chassis of the machine, consists of a cylindrical part and two flanks, said flanks being fixed by their edges to the edges of the cylindrical part, a plane defined by at least one of the flanks and a plane which is determined by the connection of the flank with the cylindrical part being different, the plane of the flank being outermost relative to the center of the tub, the projection of the contour of the flank in its plane onto a plane determined by the connection of the flank with the cylindrical part being disposed inside the contour of said connection of the flank with the cylindrical part. At least one of the flanks substantially has the shape of a truncated cone; the free edge of the flank, which corresponds to the large base of the frustum of the cone, being fixed to the cylindrical part, the central zone of the flank accommodating the drum bearings.

The device which secures the flanks to the cylindrical part is disposed in a plane which is parallel to the previously defined planes between them and nearest to the plane defined by the connection of the flank with the cylindrical part.

The drum for the tub of a washing machine described previously, which comprises a perforated cylindrical part and two circular flanks in the centres of which the drive shafts are disposed, is characterized in that the plane defined by at least one of the flanks and the plane defined by the connection of the flank with the cylindrical part are not the same, the plane of the flank being the outermost relative to the median plane of the tub; the projection of the contour of the flank in its plane onto the plane defined by the connection of the flank with the cylindrical part is disposed inside the contour of said connection of the flank with the cylindrical part.

The flanks of said drum have the shape of truncated cones, the connections between the cylindrical part and the flanks being made in the plane of the base of the frustum of the cone, the angle which the conical part of each of the flanks of the drum makes with the plane of the flank being at least equal to that of the conical part of each of the flanks of the tub, that is, the included angle of the conical part of the drum is less than or equal to that of the tub.

A loading funnel is fixed over an opening at the top of the tub, the dimensions of said funnel being such that it is not likely to come into contact with the housing walls when the lower conical part of the tub comes near a housing wall as a result of displacements owing to unbalance.

The following descriptions and drawings are given by way of example in order that the invention be more fully understood.

Figure 1:
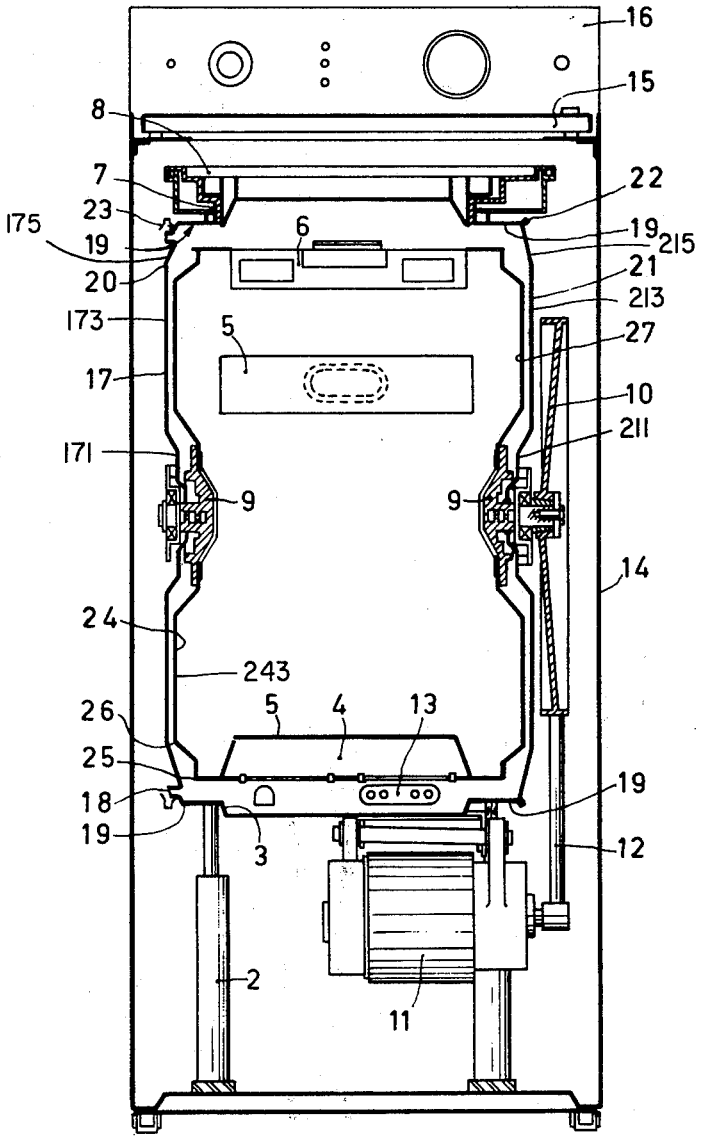
FIG. 1 is a front elevation cross-section view of a washing machine equipped with a tub and a drum according to the invention.

FIG. 1 shows a cross-section of a washing machine which comprises a chassis 1 to which legs 2 are secured which support the tub 3 in which the drum 4 with a horizontal shaft is located. Around its cylindrical part the drum 4 is provided with baffles 5 and a loading door 6. The top of the tub 3 has an opening adapted to a funnel 7 which is closed by a door 8, which door allows loading and unloading the machine. The funnel 7 consists of a part with a rectangular horizontal cross-section, obtained by molding from a thermoplastic material. The part which is fixed over the opening of the tub follows the cylindrical shape of the tub, a seal being interposed between the two. The flanks of the tub accommodate bearings 9 which allow the drum 4 to be rotated and driven by a pulley 10 which is driven by a motor 11 via a belt 12.

Water heating resistances 13 are provided at the lower part of the tub.

The assembly of tub and suspension legs is accommodated in a housing 14 which is closed at the top by a door 15. A console 16 comprises the elements required for starting and controlling the washing operations which can be performed by the machine.

Figure 2:
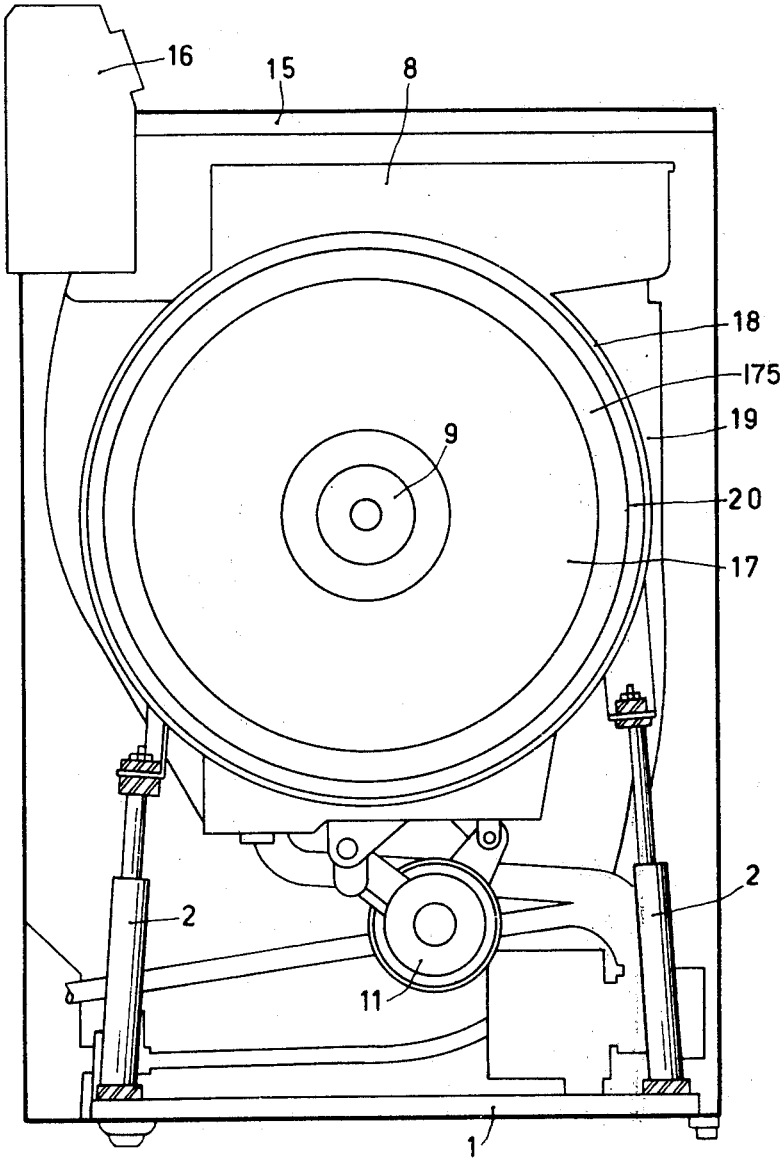
FIG. 2 is a left side view of the tub.

A plane defined by an outer planar portion of one flank of the tub, for example the flank 17 of FIG. 1, a front view of which is shown in FIG. 2, and the plane defined by the connection 18 of the flank 17 with the cylindrical part 19 are not the same. The projection of the contour of the outer edge 20 of the planar portion of the flank, onto a plane defined by the connection 18 of the flank 17 with the cylindrical part 19, is disposed inside the contour of the connection 18. This is evident from FIG. 2 where the circle 20 is concentric with and located inside the circle 18 which represents the connection of the flank 17 with the cylindrical part 19 of the tub.

In an embodiment of the tub, the flanks 17 and 21 substantially have each the shape of a truncated cone having a small base 173, 213 and a conical surface portion 175, 215, modified to have a depressed central zone 171, 211 of the small base of the cone, as hereinafter described. The edge of the flank which corresponds to the large base of the frustum of the cone is fixed to the cylindrical part 19 in accordance with the lines 18 and 22 (the fixing device 22 in FIG. 1 representing the connection line 22), the central zones of the flanks accommodating the bearings 9 of the drum.

The fixing devices 22 and 23 (FIG. 1), which make the connections between the flanks and cylindrical part, are located between, and designed so that they do not extend beyond, the planes which are defined by the planar portions 213, 173 of the flanks 21 and 17 bounded for example by the edge 20, which form the small bases of the frustums of the cones. Said fixing devices, which are known per se, exist in two types. The fixing device 22 is obtained by welding the two small flanges provided at the free edge of the flank and the cylindrical part of the tub. The fixing device 23 is an example of sealing by crimping, the edges of the flank and the cylindrical part which cooperate are formed so as to accommodate a seal and a crimping channel.

The conical surface portions 175, 215 which are disposed between the plannar portions 173, 213 of the flanks 17 and 21 and the cylindrical part 4 must have a sufficient width in order to ensure that the arrangement is really effective during displacements of the tub as a result of the unbalance of the load of laundry in the drum. Said width is determined by experiment and depends on the distance of the flanks of the tub to the housing, and on the shock-absorbers on which it rests.

In order to provide as large a drum volume as possible, it is necessary to design a drum which is adapted to the shape of the truncated cone of the tub surfaces, while it is equally necessary that the drum like the tub has such a shape that the plane defined by a plannar portion 243 at least one of the flanks, for example 24 (FIG. 1), and the plane defined by the connection 25 of the flank with the cylindrical part of the drum 4, are not the same; the plane of the portion 243 of the flank 24 is outermost relative to the center of the tub. The projection of the contour 26 of the outer edge of the planar portion 243 of the flank 24 onto the plane defined by the connection 25 of the flank with the cylindrical part of the drum 4, is located inside the contour of said connection 25 of the flank with the cylindrical part of the drum 4, in the same manner as is shown in FIG. 2 with regard to the tub.

In an embodiment which is adapted to the embodiment of the tub previously described the flanks 24 and 27 of the drum have the shape of a truncated cone, the connection between the cylindrical part of the drum 4 and the flanks being established along the base of the frustum of the cone, the angle which the conical parts of the flanks of the drum make with the plane of the flank being at least equal to that of the conical parts of the flanks of the tub.

FIG. 1 shows an example in which the angle of the conical part of the drum relative to the plannar portion is greater than that of the conical part of the tub. Said angle depends on the method of fixation of the flanks to the cylindrical part of the drum. In the present case, the flanks are fixed by crimping along a projecting edge; it is therefore necessary that said projecting edge cannot contact the walls of the tub and consequently that the angle of the conical parts of the flanks is greater than that of the flanks of the tub. If no projecting edge is required for fixation, the angle of the flanks of the drum may be equal to that of the flanks of the tub.

The embodiment of the tub shown in FIGS. 1 and 2 comprises two flanks each having a conical part of the same conicalness but it is equally possible to have a tub which has only one conical flank or a tub having flanks of different conicalness.

In FIG. 1 it is evident that such an embodiment allows movements of the tub in the plane of the drawing of greater amplitude than would be permissible with a conventional tub of which the plane of connection of the flanks with the cylindrical part of the tub would be the same or even, which is frequently the case, of which the connection of the flanks to the tub is made in a plane disposed in front of the plane of the flanks in accordance with a crimping or welding flange.

The embodiment described particularly applies to a top-loading machine, but it is equally possible to use the invention in a machine of the front-loading type.

What is claimed is:

1. A laundry washing and spin-drying machine having a high ratio of drum volume to housing width, comprising a housing, a tub, means for resiliently mounting said tub within said housing, a drum mounted within said tub for rotation about a horizontal axis, means for driving said drum at agitating speed for washing and at high speed for spin-drying, and means for obtaining access to the interior of the drum to insert and remove laundry, said tub comprising:

a cylindrical part having two end edges; two flanks, each of said flanks comprising a truncated conical surface extending outward, said truncated surface having a large base edge and a small base edge, said base edges lying in parallel planes, the large base edge of each flank adjoining a respective end edge of the cylindrical part, each flank further comprising a substantially planar surface having an outer edge fixed to said small base edge; and means for fixing each large base edge to the respective end edge, said fixing means being entirely located inwardly of the plane in which said small base edge lies, whereby said fixing means has adequate clearance from said housing despite angular movements of said axis due to laundry unbalance during spin-drying.

2. A machine as claimed in claim 1, wherein said fixing means lies in a plane parallel to the planes in which said large and small bases lie, closer to the large base.

3. A machine as claimed in claim 2, wherein said drum is mounted in bearings fitted in a dished central portion of each flank, and said substantially planar surface is an annular surface having an inner surface connected to said dish central portion.

4. A machine as claimed in claim 3, wherein said drum is concentric within said tub, and comprises a cylindrical part and two flanks having a configuration corresponding to those of the tub, each drum flank being adjacent a respective tub flank, said drum flanks each comprising a truncated conical surface extending outward, said drum flank truncated surface having a large base edge and a small base edge, said drum base edges lying in parallel planes, the large base edge of each drum flank adjoining a respective end edge of the cylindrical part, each drum flank further comprising a substantially planar surface having an outer edge fixed to said small drum flank base edge; and means for fixing each large drum base edge to the respective drum end edge, said fixing means being entirely located inwardly of the plane in which said drum small base edge lies, each tub and drum flank conical surface having an included angle, the included angle of each drum conical part being at least as small as the included angle of the corresponding conical part of the respective tub flank, whereby said drum has a volume which is maximized in comparison with that of the tub.

* * * * *